United States Patent [19]

Boston, Jr. et al.

[11] Patent Number: 4,900,109

[45] Date of Patent: Feb. 13, 1990

[54] VERSATILE DISHWASHER FRONT CONSTRUCTION

[75] Inventors: Ray W. Boston, Jr.; Neil K. McDonald; LeRoy J. Herbst, all of Louisville, Ky.

[73] Assignee: General Electric Company, Louisville, Ky.

[21] Appl. No.: 332,970

[22] Filed: Apr. 4, 1989

[51] Int. Cl.[4] ..... A47B 81/00

[52] U.S. Cl. ..... 312/276; 312/204; 312/228

[58] Field of Search ..... 312/275, 276, 319, 204, 312/228

[56] References Cited

U.S. PATENT DOCUMENTS

| | | | |
|---|---|---|---|
| 2,720,683 | 10/1955 | Schwenker et al. | 312/204 X |
| 2,958,911 | 11/1980 | Given et al. | 52/803 |
| 3,044,106 | 7/1962 | Papsdorf | 16/179 |
| 3,150,904 | 9/1964 | Kendt et al. | 312/276 |
| 3,393,950 | 7/1968 | Outcher et al. | 312/276 |
| 3,773,399 | 11/1973 | Sulcek | 312/204 |
| 3,826,553 | 7/1974 | Cushing et al. | 319/203 |
| 3,912,350 | 10/1975 | Gurubatham | 312/276 |
| 4,095,311 | 6/1978 | Janosch | 16/163 |
| 4,229,921 | 10/1980 | Schell | 312/204 X |
| 4,359,250 | 11/1982 | Jenkins | 312/228 |
| 4,441,770 | 4/1984 | Brezosky | 312/276 |

*Primary Examiner*—Joseph Falk

*Attorney, Agent, or Firm*—Radford M. Reams; H. Neil Houser

[57] ABSTRACT

A dishwashing machine includes a door pivotally mounted for selectively exposing the interior of the machine for loading and unloading dishes or other items to be washed. An outer decorative door panel is mounted on the door for pivotal movement with the door and a lower decorative panel is hingedly mounted to the outer panel. Springs resiliently connect the lower panel to the frame of the dishwasher and bias the lower panel toward a vertical position while allowing the lower panel to move as the door, including the outer panel, pivots.

4 Claims, 3 Drawing Sheets

VERSATILE DISHWASHER FRONT CONSTRUCTION

BACKGROUND OF THE INVENTION

This invention is directed to front loading dishwashers and, more particularly, to a panel arrangement for blending the appearance of the dishwasher into its surroundings, such as the cabinets in a kitchen.

In general, domestic dishwashers are built into a niche or recess in the cabinetry of a kitchen. It is desirable that the front of the dishwasher, which is exposed and can be seen by people in the kitchen, have panels or other finished surfaces which compliment or blend in with other parts of the kitchen. The two most widely used approaches are to match the front of the dishwasher to other appliances, such as a refrigerator or a range, and to match or coordinate the front of the dishwasher with the cabinetry of the kitchen. When coordinating or matching other appliances thin panels painted the same color as the other appliances are used as the front surface members for the dishwasher. On the other hand kitchen cabinets normally have wooden doors and other exposed surfaces made of wood or other relatively thick decorative material. To coordinate with such cabinets the front panels of the dishwasher need to be wood or other suitable material so as to have the same appearance as the cabinets. Some efforts have been made in the past to provide dishwasher structures that could accommodate wooden panels to match wooden cabinets. For example, U.S. Pat. No. 2,958,911 issued on Nov. 8, 1960, to Given, et al illustrates and describes one such dishwasher door structure. As typified by Given, et al, such prior art dishwasher door structures necessitated the use of relatively thin wooden panels. For example, such dishwashers normally include a door pivoted about its lower edge portion and a second stationary panel mounted across the dishwasher below the door. Since the door pivots and the lower panel is stationary a gap must be provided between these two members to accommodate the pivotal movement of the door. The thicker the door construction the wider the gap necessary in order to accommodate the movement. Very quickly such a gap becomes unsightly and detracts from the appearance of the dishwasher. In many newer homes and newly redecorated kitchens the cabinetry is more upscale and involves the use of thicker doors. Using correspondingly thicker panels on the dishwasher in order to match the appearance of the dishwasher to the cabinetry exasperates the problem of accommodating both a moveable door and a lower panel.

It is an object of the present invention to provide a dishwasher having an improved front construction.

It is another object of the present invention to provide such a dishwasher in which thick panels, such as wooden panels, may be selectively used.

It is yet another object of the present invention to provide such a dishwasher in which the construction of the front of the dishwasher is adapted for selective modification of the appearance panels after the dishwasher has been shipped from the factory.

SUMMARY OF THE INVENTION

A dishwashing machine comprises a housing defining a chamber to receive items to be washed and an access opening for insertion and removal of the items. A door is pivotally mounted to the housing for selective movement generally about its lower edge between a generally horizontal position permitting access to the chamber and a generally vertical position closing the opening. A lower panel is pivotally connected to the lower portion of the door and extends downwardly therefrom. Spring means, pivotally connected to the lower panel and to the housing, biases the lower panel toward the housing while permitting movement of the lower panel relative to the housing as the door moves between its generally horizontal and its generally vertical positions.

DESCRIPTION OF THE PREFERRED EMBODIMENTS

Figure 1:
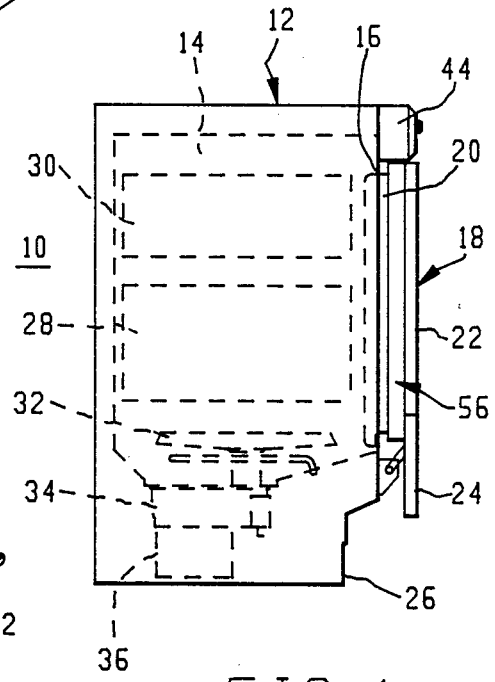
FIG. 1 is a somewhat schematic side elevational view of a dishwasher one form of the present invention.

FIG. 1 of the drawings illustrates a dishwasher 10 having a housing or housing structure 12 defining an inner dishwashing chamber or tub 14. The front of the housing 12 is provided with an access opening or doorway 16 through which dishes or other items to be washed can be inserted and removed. A door structure 18 is pivotally mounted adjacent its lower edge for movement about the hinge or pivotal axis between an upright, generally vertical position closing the opening 16 and a down, generally horizontal position exposing the opening 16 for access to the tub 14. As will be more fully explained hereinafter, the door structure 18 includes an inner door panel 20 which is mounted for pivotal movement to selectively open and close the opening 16. An outer decorative panel 22 is attached to the door for concurrent pivotal movement. The door 18 also typically includes an additional panel positioned between inner panel 20 and decorative panel 22 and forming, with panel 20, a space for mounting a detergent dispenser and forming a passage for air during drying. Such well known elements have been omitted here for the sake of simplicity. A lower decorative panel 24 is pivotally mounted to the lower edge of the outer panel 22. The front of the dishwasher housing below the lower panel 24 is set back to provide a toe kick or recess 26.

Dishes and other items to be washed, rinsed and dried may be placed in a lower rack 28 and an upper rack 30. The racks are mounted to the housing within the chamber 14 and are moveable, so that when the door is open, the racks may be pulled forwardly or outwardly through the opening 16 to provide access for loading or unloading the items. The racks then are pushed into tub 14 before the door structure 18 is closed. In order to wash and rinse the items carried by the racks 28 and 30, water, with a suitable detergent for washing and without a detergent for rinsing, is sprayed upwardly over the dishes by an impeller 32. Typically the impeller is of a reaction type and is supplied with water from the bottom of the tub or chamber 14 by pump 34 driven by motor 36. While a single impeller 32 has been shown for simplicity, it will be understood that typical domestic dishwashers have several levels of washing action. Thus, in addition to impeller 32, another spray device may be positioned in the middle of the chamber and an additional impeller may be mounted to spray water downwardly from the top of the chamber or tub 14.

The present invention is adapted for use with any of a number of basic dishwasher constructions well known in the art. In some such dishwashers the chamber or tub 14 is of a stainless steel construction. In others the housing may be formed by a metal provided with an enamel liner on its interior surfaces to prevent rusting of the liner. In still others the housing or liner forming the washing chamber or tub may be formed from a unipartite plastic body. U.S. Pat. Nos. 3,826,553, Cushing, et al and 4,359,250, Jenkins, each of which is assigned to General Electric Company assignee of the present invention, illustrate and describe various aspects of two such plastic tub constructions. Each of these patents are hereby incorporated herein by reference.

Figure 2:
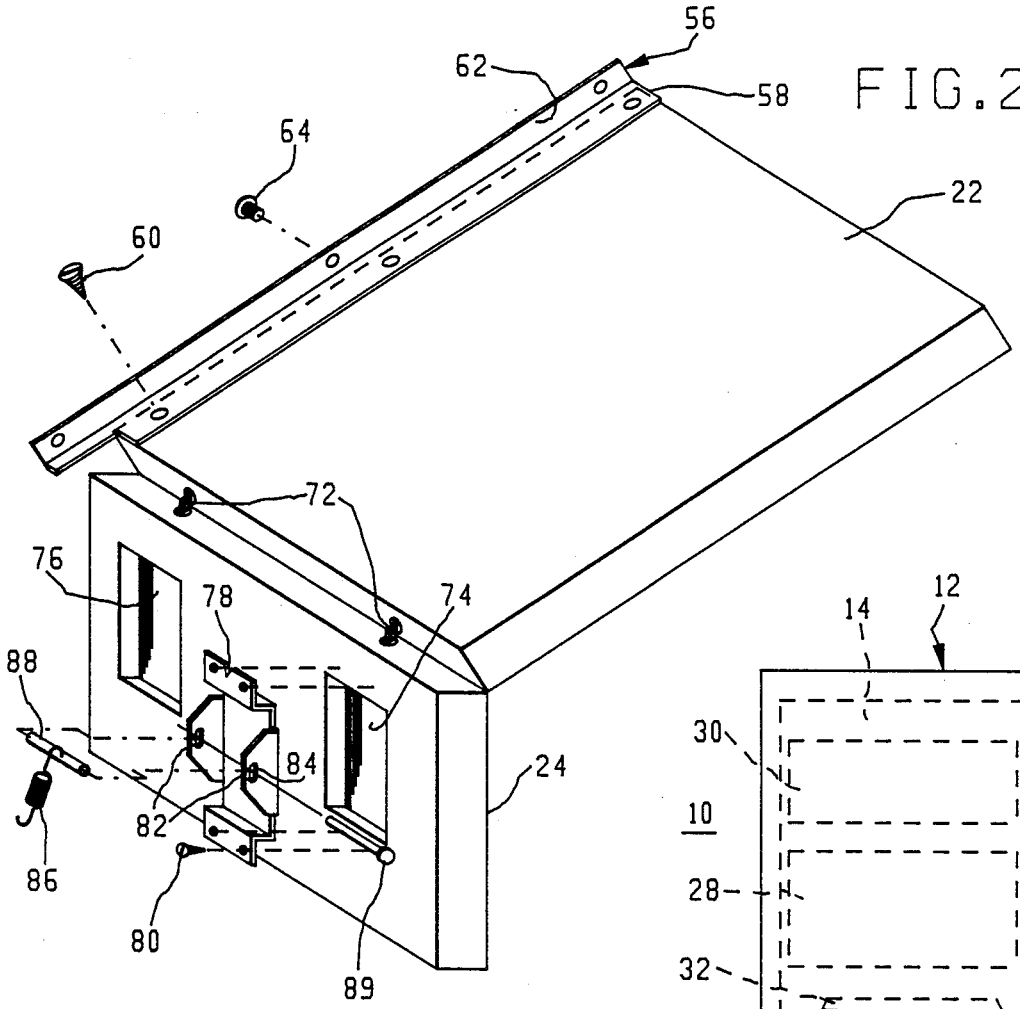
FIG. 2 is a somewhat schematic, perspective view of the outer panel and the lower panel used in one form of the present invention, in conjunction with associated hardware, and with some parts omitted for the sake of simplicity.
Figure 3:
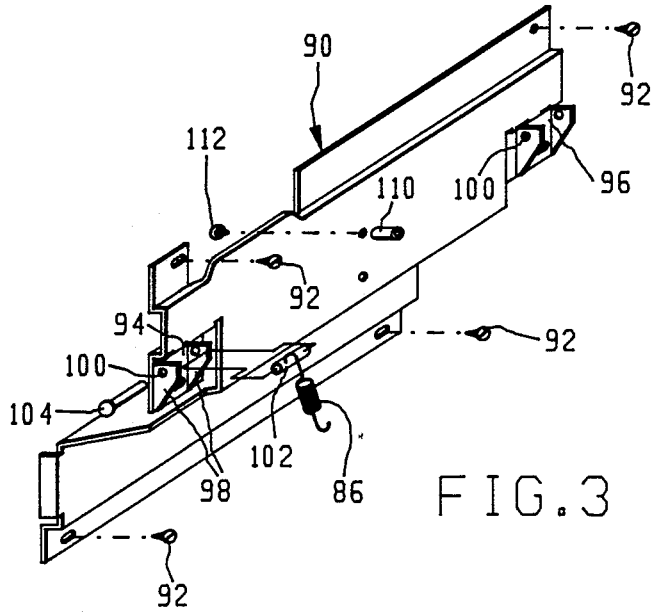
FIG. 3 is a perspective view of the support or access panel and related operating components for a dishwasher incorporating one form of the present invention.
Figure 4:
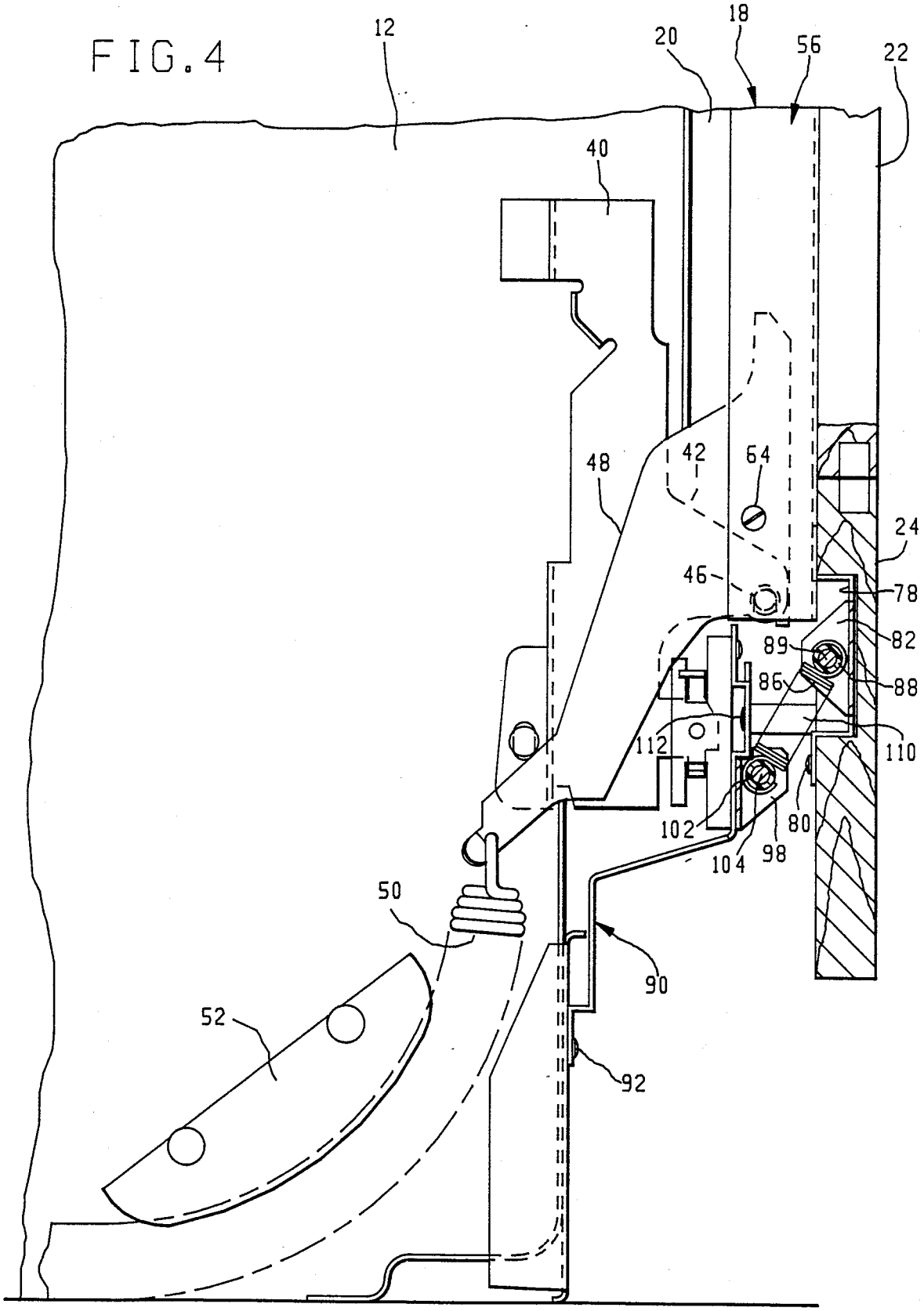
FIG. 4 is a fragmentary side elevational view of a dishwasher incorporating a door and panel construction in accordance with one form of the invention and showing the door in its closed position.
Figure 5:
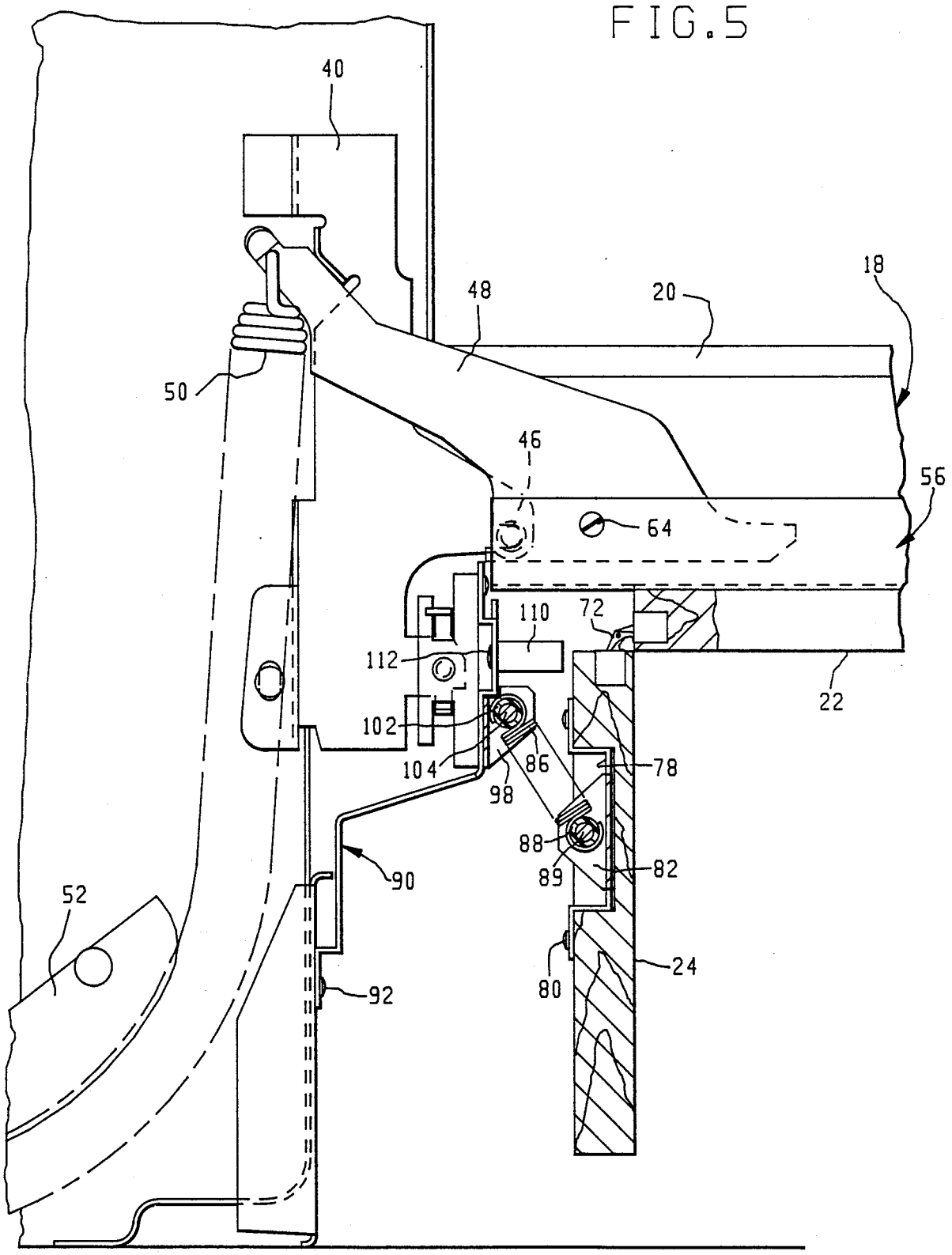
FIG. 5 is a fragmentary side elevational view similar to FIG. 4 but with the door and panel construction in its open position.

Referring more particularly to FIGS. 2, 3 and 4, the housing 12 conveniently may be molded as a unitary body of plastic material. A reenforcing bracket 40 is attached to each side of the housing 12 adjacent its front. Each bracket has a nose 42 which extends outwardly and overlaps an inner panel 20 of the door structure 18. A hinge mechanism generally indicated at 46 pivotally connects the lower edge portion of the door structure 18 to the bracket 40 and to a spring loaded arm 48. The distal end of the arm 48 as connected to an elongated spring 50 which extends around a spring guide 52 and the other end of which (not shown) is connected to the housing 12. When the door structure 18 is moved from its closed position, as seen in FIG. 4, to its open position, as seen in FIG. 5, the arm 48 stretches the spring 50. The energy stored in the spring then is available to assist the user in closing the door structure and assuring that the door has a sealed water tight engagement with the housing when in its vertical or closed position. It will be understood that the spring loaded hinged connection of the door to the bracket 40 is duplicated on each side of the door. The illustrative door construction is of a type well-known in the art and it will be understood that the present invention is adaptable for use with numerous basic door opening mechanisms.

As best seen in FIG. 2, outer decorative door panel 22 is sized to overlie and substantially cover the inner door or inner door panel 20. However, it will be recognized that the control escutcheon 44 may be mounted above the door, as shown in FIG. 1, or may be formed as part of the door 18. When part of the door, it will not be covered by the decorative panel 22. An angled bracket 56 is positioned adjacent each lateral edge of the outer panel 22 and next to each side edge of the door 18. Each angled bracket includes a first arm 58 which overlies and is attached to the back side of the panel 22 by any suitable means such as screws 60 and a second arm 62 which overlies the lateral or side edge of the door 18 and is attached thereto by screws 64 (see FIGS. 4 and 5). With the angle arms attached to both the door 18 and outer panel 22 the panel 22 is mounted to move with the door as it pivots about the center line of hinges 46.

The upper edge of a lower decorative panel 24 is pivotally connected to the lower edge of the outer panel 22 by suitable means such as hidden hinges 72. The present invention enables the panels 22 and 24 to be of a relatively thick construction and they may conveniently be thick wood panels to match adjacent cabinetry. A pair of brackets are mounted to the rear or inward side of the lower panel 24. Conveniently a pair of recesses 74 and 76 are provided in the rear surface of the panel 24. A bracket 78 is received in the recess 74 and is secured therein by suitable means such as screws 80. The bracket includes a pair of rearwardly extending arms 82 having mounting apertures 84 therein. One end of an elongated tension spring 86 is received about a sleeve or bushing 88. The bushing 88, which may be constructed of an appropriate material such as nylon for example, is received between the arms 82 and is secured by means of a clevis pin 89 which extends through the apertures 84 and is held in place by a cotter pin (not shown). This construction pivotally connects the spring 86 to the lower panel 24. While only one bracket and spring mechanism is shown it will be understood that a duplicate of such mechanism is provided for mounting to the panel 24 in conjunction with the recess 76.

Referring now particularly to FIGS. 3 and 4, a support or access panel 90 is attached to the housing below the door mechanism and becomes, in effect, an integral part of the housing. Typically such access panels are attached by means of screws and bolts such as those shown at 92. The panel 90 includes a pair of brackets 94 and 96, each of which has a pair of outwardly extending arms 98 with an opening 100 provided in each of the arms 98. The other end of the spring 86 is mounted about a suitable bushing or sleeve 102. The sleeve 102 is received between the arms 98 of the bracket 94 and is secured therein by a clevis pin 104, held in place by a cotter pin (not shown). This arrangement pivotally attaches the other end of the spring 86 to the support panel 90. Thus the spring 86 interconnects the lower panel 24 with the support panel 90 while allowing movement of the lower panel 24 as the upper panel 22 moves between its horizontal and vertical positions. It will be understood that the other end of the other tension spring (not shown) is connected to the bracket 96 in an identical manner. A spacer, such as a piece of nylon 110, is connected to the laterally middle portion of the support panel 90 by some suitable means such as screw 112.

Viewing FIGS. 4 and 5 in particular, it will be seen that the tension spring 86 urges the lower panel 24 toward the dishwasher housing while allowing the panel to move with the outer panel 22 as the door 18 pivots around hinges 46. The stop 110 assures that, when the door is in its closed position as seen in FIG. 4, the lower panel 24 is essentially vertically disposed and in alignment with the upper panel 22. The movement of the lower panel 24 is essentially vertical and, more particularly, the lower edge of the lower panel 22 does not move inwardly toward the support panel 90. Thus if a user wishes to place a facia board across the lower edge of the dishwasher housing to make even that lower portion more completely blend with the adjoining cabinets the lower panel will not hit the facia board.

It will be understood that the present construction is adaptable both to inclusion in the original manufacturer of dishwashers and to subsequent modification of dishwashers after manufacture, particularly in the home. For example, if it is intended that most of a manufacturer's dishwashers have thin decorative panels in the front, a more narrow frame could take the place of the angle brackets 56 and hold such a thin panel to the door and a thin lower panel could be stationarily mounted directly to the front of the dishwasher housing, as is typical in present day constructions. Then, for those particular users who want to have a thicker panel the original frame and decorative panel and lower panel could be removed and replaced with the construction described hereabove. With this construction, since the lower panel is hingedly mounted to the upper panel and is flexibly mounted to the support panel but biased toward the vertical position, thick panels such as those shown at 22 and 24 can be employed by those users who wish to have them. On the other hand if most or all of the decorative panels are to be relatively thick the construction described hereabove can be utilized in the original manufacturing process.

It will be recognized that individual dishwasher owners or dealers easily can change from one panel to another in order to coordinate the appearance of a particular dishwasher with its surroundings.

What is claimed is:

1. A dishwashing machine comprising:

a housing defining a chamber to receive items to be washed and an access opening for insertion and removal of the items;

a rectangular door pivotally mounted to said housing for selective movement generally about its lower edge between a generally horizontal position permitting access to said chamber and a generally vertical position closing the opening;

a rectangular outer panel sized to substantially cover said door;

a pair of brackets removably secured to said door and to said outer panel adjacent their respective lateral edges for mounting said outer panel on said door;

a rectangular lower panel;

hinge means connected to said outer panel adjacent its lower edge and to said lower panel adjacent its upper edge so that said lower panel is positioned below said outer panel for pivotal movement about said lower edge of said outer panel as said door pivots about its lower edge;

a support panel attached to the lower portion of said housing behind said lower panel;

spring means connected to and extending between said lower panel and said support panel, said spring means providing the sole connection between said lower panel and the lower portion of said housing, said spring means biasing said lower panel toward said housing while permitting said lower panel to pivot relative to said outer panel as said door moves between its generally vertical and generally horizontal positions.

2. A dishwashing machine as set forth in claim 1 further comprising stop means positioned between said support panel and said lower panel for assuring said lower panel is in a generally vertical position when said door is in its generally vertical position.

3. A dishwashing machine as set forth in claim 1 wherein each of said pair of brackets includes a first arm removably secured to a lateral edge of said door and a second arm removably secured to the inner surface of said outer panel adjacent its corresponding lateral edge.

4. A dishwashing machine as set forth in claim 1 wherein said spring means comprises:

a first pair of brackets attached to said lower panel, in laterally spaced apart relationship, a second pair of brackets positioned in laterally spaced apart relationship on said support panel;

a pair of springs pivotally connected to corresponding ones of each of said pairs of brackets.

* * * * *